United States Patent [19]

Meeker et al.

[11] Patent Number: 4,815,743

[45] Date of Patent: Mar. 28, 1989

[54] GOLF SWING GUIDE

[76] Inventors: Robert L. Meeker, 12601 Pawnee La., Leawood, Kans. 66209; William M. Crouch, 11508 Foster, Overland Park, Kans. 66210

[21] Appl. No.: 69,715

[22] Filed: Jul. 6, 1987

Related U.S. Application Data

[63] Continuation-in-part of Ser. No. 867,135, May 27, 1986, abandoned.

[51] Int. Cl.[4] ..... A63B 69/36

[52] U.S. Cl. ..... 273/183 B; 273/191 R; 273/190 R

[58] Field of Search ..... 273/190 R, 191 A, 191 R, 273/191 B, 183 B, 192, 186 R, 186 A, 186 C

[56] References Cited

U.S. PATENT DOCUMENTS

| | | | |
|---|---|---|---|
| 1,854,392 | 4/1932 | Bambrick | 273/190 R |
| 2,611,610 | 9/1952 | Hara | 273/190 R |
| 3,197,209 | 7/1965 | Arena | 273/183 R |
| 3,339,927 | 9/1967 | Nunn | 273/191 A |
| 3,341,208 | 9/1967 | Marcella | 273/191 A |
| 3,397,892 | 8/1968 | Stahl | 273/190 R |
| 3,489,416 | 1/1970 | Mark | 273/191 A |
| 3,730,531 | 5/1973 | Zega | 273/191 A |
| 4,116,447 | 9/1978 | Becker | 273/183 B |
| 4,422,643 | 12/1983 | Cushing | 273/183 B |

*Primary Examiner*—George J. Marlo

*Attorney, Agent, or Firm*—Kokjer, Kircher, Bradley, Wharton, Bowman & Johnson

[57] ABSTRACT

A guide for assisting a golfer to learn the feel of the body positions for carrying out a properly executed golf club swing. An elongated, generally C-shaped member is adjustably mounted for tilting movement on a lateral arm of an upright support. The member is tilted to the correct angle so that the planar undersurface of the member immediately overlies the plane of movement of the golfer's hands in carrying out the desired club swing with the golfer standing in an opening in one edge of the member. The member guides the golfer's hands in executing the swing. An arcuate edge of the member also serves as a guide for the hands. Structure is provided for placing the golfer's head or neck in the correct position for the practice swings. The guide is of lightweight construction and capable of ready disassembly for portability.

15 Claims, 2 Drawing Sheets

110
112
113
114
115
116
118
119
120
122
123
124
126
128
130
132
134
136
138
140
142
144
7.
8.

GOLF SWING GUIDE

This is a continuation-in-part application of Serial No. 867,135, filed May 27, 1986, and now abandoned.

This invention relates to golf practice equipment and more particularly to a device for aiding a golfer in maintaining the correct body positions during the execution of practice swings.

A variety of devices have heretofore been suggested for use by a golfer to insure that the golf club is moved through a proper trajectory during practice swings. Generally, these have often included rather elaborate systems of rails which guide the club throughout all or a major portion of a golf stroke considered to be ideal and preset into the devices by adjustments of the rails in accordance with size of the golfer, length of the club, and the like.

While devices as shown and described in these patents are undoubtedly useful for demonstrating to the golfer the path which a golf club should follow during the swing, they are not very effective in insuring that the golfer maintains optimum body positions during practice so that the golfer is likely to execute the swing properly when the aid is no longer used. The rails of such devices serve as artificial crutches to keep the club on a correct path despite the body positions assumed by the golfer. When the crutch is removed, any faults in the golfer's body positions will inevitably result in defects in the swing.

Other devices have heretofore been suggested for physically limiting portions of the golfer's body to certain positions during practice swings. These devices are either extremely complex or concentrate only on one particular part of the body to the exclusion of others. Further, while devices of this kind may serve to demonstrate correct positions, the physical restraints on the body imposed by the devices do little to assure that the golfer will develop the proper feel for the correct range of motions required for an optimum golf stroke.

Accordingly, a primary object of the present invention is to provide a training aid for golfers which assures that the golfer will move the club through a proper path of travel, but which requires the golfer to assume the proper body positions throughout the entire range of motions involved in the stroke to learn the feel of such motions for properly duplicating the stroke without the assistance of the training aid.

Another important object of the present invention is to provide an aid of this type which is readily adjustable for accommodating golfers of different sizes and also for practicing various strokes with any type of club.

Still a further object of this invention is to provide such a golf training aid which may be economically fabricated from relatively inexpensive materials so that the cost of the training aid may be such that it can reasonably be made available to golfers of only modest economic means.

A yet further object of the present invention is to provide a golf training aid of the type described which is highly portable and which may be readily assembled and disassembled for convenient installation and removal from a golf practice area as may be desired.

These and other important aims and objectives of this invention will be further explained or will become apparent from the following description and claims.

Figure 3:
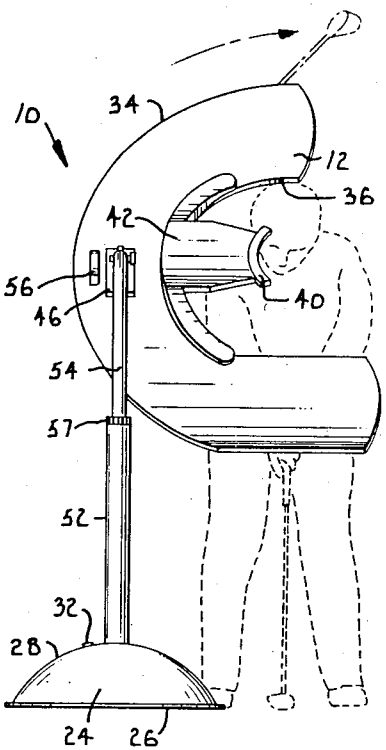
FIG. 3 is a front elevational view thereof showing the golfer as in FIG. 2.
Figure 2:
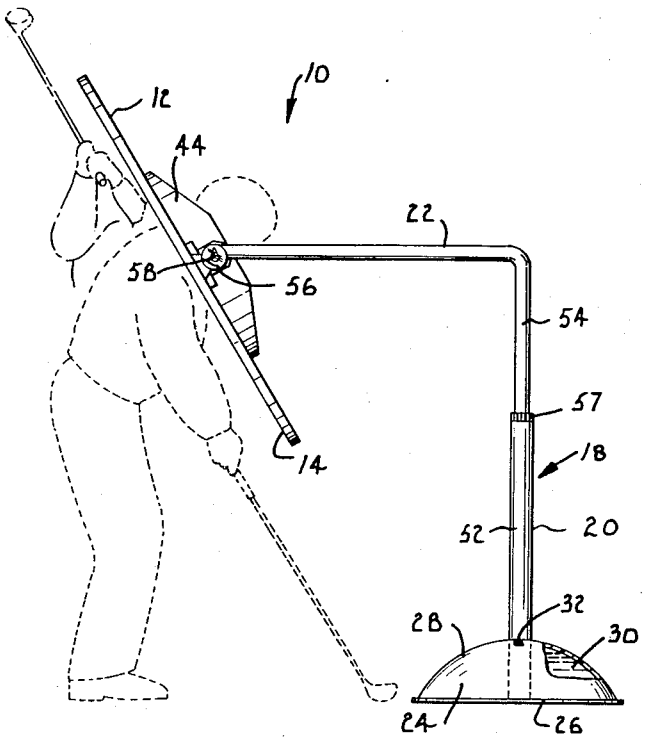
FIG. 2 is a side elevational view thereof, a golfer being shown in broken lines to illustrate how the training aid may be used.
Figure 1:
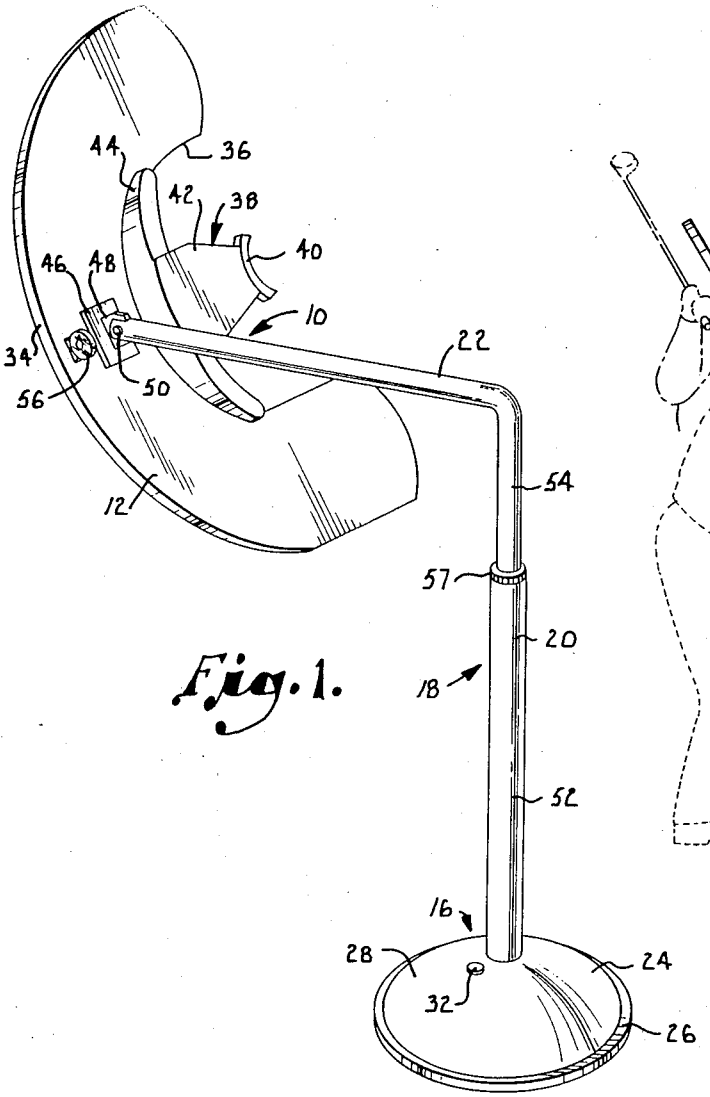
FIG. 1 is a perspective view of one embodiment of a golf training aid embodying the principles of this invention.

Referring to the drawings, and initially to FIGS. 1–3, one embodiment of a training aid for golfers in the nature of a golf swing guide is broadly designated by the reference numeral 10. Guide 10 comprises an elongated, generally planar member 12 having a generally planar undersurface 14 and a support 16 for holding the member in an elevated position above the ground or a supporting surface. Support 16 comprises an L-shaped upright 18 having a vertically extending leg 20 and a leg 22 which may be integral with the upper end of leg 20 and extending laterally therefrom as shown in the drawing.

The lowermost end of the upright leg 20 is secured to a preferably hollow base 24 formed of a flat bottom 26 and a domed top 28 defining therebetween a chamber 30 adapted to receive a liquid weight, such as water or the like, for stabilizing the guide. An opening provided with a cap 32 permits the addition and removal of the liquid from the base.

Member 12 comprises a generally planar sheet of preferably lightweight rigid plastic material such as polystyrene or the like. The member has an elongated, substantially uniformly arcuate major edge 34 on one side. The other side of the member is provided with an opening therethrough in the form of a notch 36 so that the golfer may stand with his head projecting through the plane of the member with the member disposed at an angle as illustrated in FIGS. 2 and 3 of the drawing. The arc of edge 34 is generally concentric to the path of movement of the golfer's hands in swinging the club through a desired golf swing.

Structure for supporting the neck of the golfer at the proper position throughout a practice golf swing is mounted on member 12 and is broadly designated by the reference numeral 38. Structure 38 is in the nature of a guide to insure that the golfer assumes the correct position for executing the swing by placing the neck adjacent a curved inner edge member 40 mounted on a laterally extending arm 42 projecting over the open notch 36 in member 12 as shown in the drawing. The innermost edge of notch 36 has an elongated spacing member 44 secured thereto and projecting upwardly from the top surface of the member. The proximal end of arm 42 is secured to the uppermost edge of member 44 so that the curved edge 40 is appropriately spaced upwardly from the top surface of member 12. Obviously, the curve of member 40 is such as to complementally engage the neck of the golfer to comfortably provide a rest against which the golfer may hold his neck throughout the execution of the golf swing as will be subsequently more fully described.

Member 12 is pivotally mounted to the projecting end of arm 22 by a bracket 46 secured to the member and having an ear 48 projecting outwardly therefrom. Ear 48 is received in a slot in the end of the arm and is secured for pivotal movement about a horizontal axis by a bolt 50 extending transversely through the arm as shown best in FIG. 1 of the drawing. With this arrangement, the angle at which member 12 is tilted with respect to the supporting surface can be readily adjusted as may be required. The upwardly extending leg 20 of upright 18 preferably consists of a pair of relatively telescoped sections 52 and 54 with a friction locking device 57 provided to permit selective interlocking of the sections at any desired relatively telescoped position for adjusting the vertical height of the member. Preferably, support 16 including base 24 may be constructed of lightweight plastic material to enhance the portability of the guide. Further, an angle indicator 56 may be attached to the member to assist the golfer in rapid adjustment of the guide. Indicator 56 is in the nature of an instrument having a pivoted pointer 58 which is operated by gravity to indicate the angle from horizontal of the member 12 at all times irrespective of possible positioning of support 16 at some angle different from vertical.

In use, a golfer may install the guide 10 at a location such as on a golf course or any other suitable site for practicing a golf swing. The golfer assumes the position generally as illustrated in FIGS. 2 and 3 of the drawing with his head extending through the notch 36 and the plane of member 12. In this position, the member 12 is disposed at an angle immediately overlying and parallel to the desired plane of the movement of the golfer's hands while carrying out the desired golf swing. The golfer installs his neck adjacent or against the arcuate member 40 and holds his neck in this position throughout the practice swing.

In carrying out the swing immediately beneath member 12, the latter physically prevents the golfer from moving his hands substantially upwardly from the desired plane of the swing. Also, member 12 serves as a guide throughout the swing for the golfer to keep his hands relatively close to the member, thereby insuring that the hands are not permitted to move downwardly out of the desired plane. The elongated curved edge 34 is generally concentric to the path of movement of the arms through the swing and this serves as a further guide to the golfer while carrying out the swing.

The hands and body of the golfer are not physically supported during the swing and this permits the golfer to obtain a natural feel for the correct golf swing while guided throughout the swing by the inclined member. The muscle memory acquired by the use of this swing guide is of a kind which is subject to greater retention than with guides of a type which physically support the club or restrain the body. Practice of golf swings carried out with the device of this invention are therefore more likely to be retained and provide long term benefits which improve the golfer's skills in executing the swing of the club without the aid of the guide.

It will be, of course, apparent that golfers of different physical stature will require different adjustments to the components of the guide. Further, adjustments may be desired for different types of strokes. The ready adjustability of the legs of the support permit the guide member to be disposed at the proper height, regardless of the height of any particular golfer. Further, the appropriate angle of the swing can be preselected as desired and the member 12 adjusted to properly define that angle.

The components of this invention are preferably of extremely lightweight, yet durable construction so that the components can be readily transported from place to place. To this end, the components can be quickly and easily disassembled and separated from one another to enhance this portability. The provision of the liquid containing chamber 30 in base 24 permits the golfer to add water or the like as a weight to increase the stability of the guide at the practice site. This liquid can be readily emptied from the base to reduce the overall weight for transporting to and from the practice site.

The generally C-shaped construction of the swing guide member 12 provides the necessary guidance for the stroke throughout the entire swing, yet lets the golfer readily move into and away from the practice position.

Referring now to FIGS. 4–8, another embodiment of a golf swing guide of the present invention is represented generally by the numeral 110. Guide 110 comprises a padded, generally C-shaped member 112 which is circular in cross-section and an adjustable support 114 which allows adjustable positioning of the member 112. Member 112 comprises arcuate portion 113 and a straight leg portion 115 integral with portion 113 and extending generally radially inwardly therefrom. Both portions 113 and 115 lie in a common imaginary plane.

Figures 4, 5, 6, 7, 8:
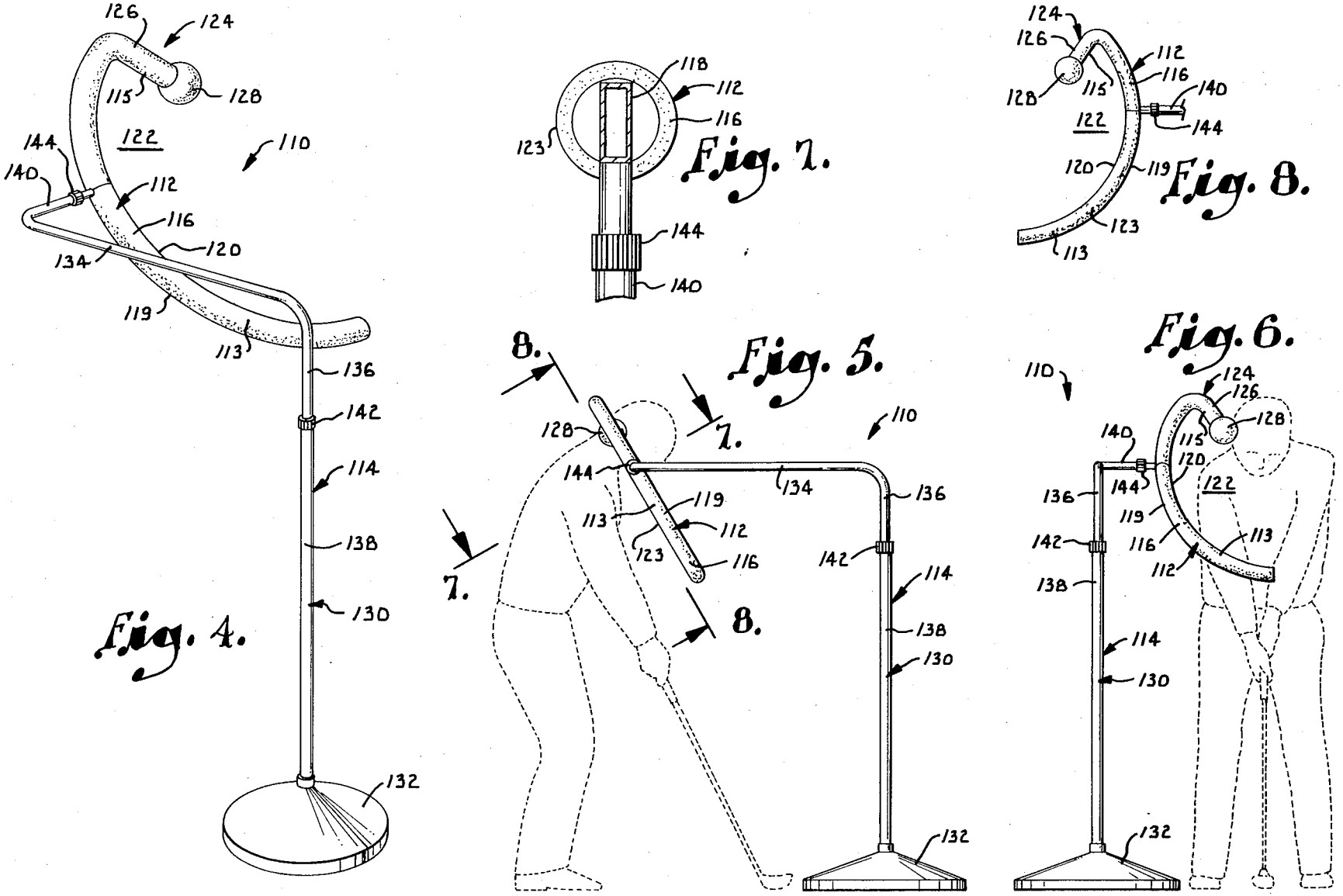
FIG. 4 is a perspective view of another embodiment of a golf training aid embodying the principles of this invention.
FIG. 5 is a side elevational view of the training aid shown in FIG. 4, with a golfer being shown in broken lines to illustrate how the training aid may be used.
FIG. 6 is a front elevational view of the training aid shown in FIG. 5 with the golfer positioned as in FIG. 5.
FIG. 7 is a sectional view of a portion of the training aid taken along line 7—7 of FIG. 5.
FIG. 8 is a fragmentary view taken along line 8—8 of FIG. 5.

Member 112 includes a generally tubular sheath or padding 116 of lightweight semi-soft plastic material which encases a rigid inner core 118 (FIG. 7). Core 118 is preferably hollow and may be constructed of suitably rigid materials which are preferably of lightweight construction to allow for portability of the guide 110. Member 112 has an elongated curved edge 119 along one side and a curved edge 120 along the other side. The longitudinally curved or arcuate edge 120 of member 112 proximal the center of curvature of the latter defines an opening 122 which allows the head of the golfer to project through the plane of member 112.

The undersurface 123 of member 112 is generally arcuate in cross-section with the extreme lowermost portion along the undersurface defining a planar surface. Structure 124 in the form of portion 115 for indicating the proper position for the golfer's head and neck projects inwardly from an upper end of member 112 to a position intermediate the ends of member 112 and lying in the same plane as the member. Structure 124 terminates in a spherically shaped rest 128 positioned on the extreme outermost end of the straight portion or spacing member 124. Rest 128 is preferably constructed of a relatively soft, readily deformable resilient material to reduce any localized pressure in the event the head or neck of the golfer engages the rest.

The support 114 comprises an upright 130 which is secured to a base 132. The upright 130 includes a horizontally extending portion 134 with a downwardly projecting portion 136 which telescopes within a support leg 138. Horizontal portion 134 also includes a laterally extending portion 140 which is coupled with member 112. A friction lock 142 couples downwardly projecting portion 136 with the support leg 138 and allows adjustable vertical positioning of member 112. Another friction lock 144 couples portion 140 with member 112 and allows rotational positioning of the member.

The guide 110 may be used in a manner similar to guide 10 previously described. The elevation of member 112 is adjusted so that the head of the golfer is immediately adjacent the spherical rest 128 when the golfer is in the position shown in FIGS. 5–6. Member 112 is then rotated so that the plane along the undersurface 123 overlays and is substantially parallel to the arc defined by the desired swing of the golfer. Member 112 is thus in a position to prevent the golfer from moving his hands upwardly from the desired plane of the swing. More importantly, however, the member serves to indicate to the golfer by its presence the desired arc of swing to be followed by the golfer's hands in executing the preferred golf swing.

Spherical rest 128 serves as a reference for the proper positioning of the golfer's head and neck. The spherical rest 128 does not physically support the neck or head of the golfer but merely serves as an indicator of the proper positioning for the golfer's head without physically restraining the golfer's body. This enables the golfer to more quickly learn to maintain the proper head positioning during the golfing swing.

The padding 116 on member 112 is particularly advantageous in that it allows the distance of separation between the golfer's swing and the member 112 to be minimized without risk of injury to the golfer which might otherwise result from contact with a rigid guide. The padding thus allows the golfer's hands to closely follow the member 112 during the swing and reduces the likelihood of flinching or otherwise deviating from the desired path of travel. The golfer may concentrate on the swing and more quickly develop the muscle memory required for accomplishing consistent and accurate swings.

The C-shaped construction of member 112 provides the necessary guidance through the entire range of the practice swing while allowing the golfer to readily move into and away from the practice position. The adjustability of the guide 110 allows the guide to be used by golfers of various size and stature for practicing different types of strokes necessary for an improved golf game. In practice, the guide of this invention has proven highly advantageous in improving the golf game for many golfers.

Having thus described the invention, we claim:

1. A training aid for use by a golfer for practicing golf swings, said aid comprising:

an elongated member having an undersurface defining a plane and an elongated arcuate edge immediately overlying and generally concentric with the arc of the path of movement of the golfer's hands while executing a desired golf swing, said member having an opening extending transversely through the member and of sufficient size to accommodate the golfer's head; and means supporting said member in an elevated position with said undersurface immediately overlying and parallel to the desired plane of movement of the golfer's hands during the golf swing, whereby the golfer may stand with his head extending through said opening to carry out said swing with the golfer's hands guided for movement throughout said swing by said overlying undersurface of said member.

2. A training aid as set forth in claim 1, wherein said opening is a notch extending from one side edge of the member to facilitate entry and egress of the golfer to and from the position for executing the swing while guided by the aid.

3. A training aid as set forth in claim 1, said aid including means mounted on the member in disposition adjacent said opening for positioning the neck of the golfer in proper position for executing said swing.

4. A training aid as set forth in claim 3 wherein said positioning means includes a structure carried by the member and projecting into said opening, said structure including a terminal portion in disposition for placement of the golfer's neck adjacent said portion while carrying out said swing.

5. A training aid as set forth in claim 4, wherein said terminal portion is arcuate to complementally embrace the neck of the golfer.

6. A training aid as set forth in claim 4, wherein said terminal portion comprises a spherical rest for placement against the golfer's head during said swing.

7. A training aid as set forth in claim 1, said supporting means including a stand having an upright extending upwardly from a supporting surface, and means mounting the member to said upright for adjustably holding the latter in any predetermined angle as may be required for defining the swing plane desirable for a particular golfer.

8. A training aid as set forth in claim 7, said stand including a base, said upright including a first leg secured to the base and extending upwardly therefrom, and a second leg secured to said first leg and extending laterally therefrom, said member being secured to the end of said second leg remote from said first leg by said adjustable means.

9. A training aid as set forth in claim 8, said base including a chamber adapted to receive a liquid weight for stabilizing the aid during use by a golfer.

10. A training aid as set forth in claim 1, wherein said member is formed of relatively lightweight, rigid plastic material to enhance the portability of the aid.

11. A training aid as set forth in claim 1, wherein said undersurface is padded.

12. A training aid for use by a golfer for practicing golf swings, said training aid comprising:

an elongated member having a padded undersurface defining a plane and an elongated arcuate edge immediately overlying and generally concentric with the arc of the path of movement of the golfer's hands while executing a desired golf swing;

a support for positioning the member at an elevated location with said undersurface immediately overlying and parallel to the desired plane of movement of the golfer's hands during said golf swing; and means mounted on said member for positioning the head of said golfer adjacent said member during the swing, whereby the golfer's hands are guided for movement throughout said swing by said undersurface.

13. A training aid as set forth in claim 12, including an opening extending transversely through the member and wherein said positioning means includes a structure carried by the member and projecting into said opening, said structure including a terminal portion in disposition for placement of the golfer's neck adjacent said portion while carrying out said swing.

14. A training aid as set forth in claim 13, wherein said terminal portion is arcuate to complementally embrace the neck of the golfer.

15. A training aid as set forth in claim 13, wherein said terminal portion comprises a spherical rest for placement against the golfer's head and neck during said swing.

* * * * *